US009646625B2

(12) United States Patent
Chon et al.

(10) Patent No.: US 9,646,625 B2
(45) Date of Patent: May 9, 2017

(54) AUDIO CORRECTION APPARATUS, AND AUDIO CORRECTION METHOD THEREOF

(71) Applicants: SAMSUNG ELECTRONICS CO., LTD., Suwon-si (KR); SEOUL NATIONAL UNIVERSITY R&DB FOUNDATION, Seoul (KR)

(72) Inventors: Sang-bae Chon, Suwon-si (KR); Kyo-gu Lee, Seoul (KR); Doo-yong Sung, Seoul (KR); Hoon Heo, Suwon-si (KR); Sun-min Kim, Suwon-si (KR); Jeong-su Kim, Yongin-si (KR); Sang-mo Son, Suwon-si (KR)

(73) Assignees: SAMSUNG ELECTRONICS CO., LTD., Suwon-si (KR); SEOUL NATIONAL UNIVERSITY R&DB FOUNDATION, Seoul (KR)

( * ) Notice: Subject to any disclaimer, the term of this patent is extended or adjusted under 35 U.S.C. 154(b) by 0 days.

(21) Appl. No.: 14/654,356

(22) PCT Filed: Dec. 19, 2013

(86) PCT No.: PCT/KR2013/011883

§ 371 (c)(1),
(2) Date: Jun. 19, 2015

(87) PCT Pub. No.: WO2014/098498

PCT Pub. Date: Jun. 26, 2014

(65) Prior Publication Data

US 2015/0348566 A1 Dec. 3, 2015

Related U.S. Application Data

(60) Provisional application No. 61/740,160, filed on Dec. 20, 2012.

(30) Foreign Application Priority Data

Dec. 18, 2013 (KR) ..... 10-2013-0157926

(51) Int. Cl.
*G10L 11/04* (2006.01)
*G10L 21/013* (2013.01)
(Continued)

(52) U.S. Cl.
CPC ..... *G10L 21/013* (2013.01); *G10H 1/366* (2013.01); *G10H 2210/051* (2013.01);
(Continued)

(58) Field of Classification Search
CPC ..... G10L 25/90; G10L 19/02; G10L 15/12; G10L 25/24; G10L 19/06; G10L 19/125;
(Continued)

(56) References Cited

U.S. PATENT DOCUMENTS 5,749,073 A * 5/1998 Slaney ..... G10H 7/008 704/203
2008/0190271 A1* 8/2008 Taub ..... G10H 1/0058 84/645
(Continued)

FOREIGN PATENT DOCUMENTS

JP 2010-26512 A 2/2010
WO 2005/010865 A2 2/2005

OTHER PUBLICATIONS

Search Report dated Apr. 22, 2014 issued by the International Searching Authority in counterpart International Patent Application No. PCT/KR2013/011883 (PCT/ISA/210).
(Continued)

*Primary Examiner* — Huyen Vo
(74) *Attorney, Agent, or Firm* — Sughrue Mion, PLLC

(57) ABSTRACT

An audio correction apparatus and an audio correction method. The audio correction method includes: receiving
(Continued)

audio data, which may be input by a user and/or an instrument uttering sounds; detecting onset information by analyzing harmonic components of the received audio data; detecting pitch information of the received audio data based on the detected onset information; comparing the audio data with reference audio data and aligning the two based on the detected onset information and the detected pitch information; and correcting the aligned audio data to match the reference audio data.

17 Claims, 15 Drawing Sheets

(51) Int. Cl.
*G10H 1/36* (2006.01)
*G10L 25/90* (2013.01)

(52) U.S. Cl.
CPC . *G10H 2210/066* (2013.01); *G10H 2210/385* (2013.01); *G10H 2250/031* (2013.01); *G10H 2250/631* (2013.01); *G10L 25/90* (2013.01)

(58) Field of Classification Search
CPC ..... G10L 25/78; G10L 25/06; G10L 25/18; G10L 15/04; G10L 19/025; G10H 1/0058; G10H 7/008; G10H 1/0008
USPC ..... 704/200, 203–209, 214, 270, 272
See application file for complete search history.

(56) References Cited

U.S. PATENT DOCUMENTS

2009/0271197 A1 10/2009 Nyquist et al.
2010/0011939 A1 1/2010 Nakadai et al.
2010/0299144 A1* 11/2010 Barzelay ..... G10H 1/0008 704/233
2011/0004467 A1* 1/2011 Taub ..... G10L 25/90 704/207

OTHER PUBLICATIONS

Written Opinion dated Apr. 22, 2014 issued by the International Searching Authority in counterpart International Patent Application No. PCT/KR2013/011883 (PCT/ISA/237).

* cited by examiner

FIG. 6B

X

Y

| | | | | | | | |
|---|---|---|---|---|---|---|---|
| 0 | inf | inf | inf | inf | inf | inf | inf |
| inf | 0 | 0 | 1 | 1 | 1 | 1 | 1 |
| inf | 1 | 1 | 0 | 0 | 1 | 1 | 1 |
| inf | 1 | 1 | 1 | 1 | 0 | 1 | 1 |
| inf | 1 | 1 | 1 | 1 | 1 | 0 | 1 |
| inf | 1 | 1 | 1 | 1 | 1 | 1 | 0 |

AUDIO CORRECTION APPARATUS, AND AUDIO CORRECTION METHOD THEREOF

CROSS-REFERENCE TO RELATED APPLICATIONS

This application claims the benefit of priority from Korean Patent Application No. 10-2013-0157926, filed on Dec. 18, 2013 and U.S. Provisional Application No. 61/740,160 filed on Dec. 20, 2012, the disclosures of which are incorporated herein by reference in their entireties. This application is a National Stage Entry of the PCT Application No. PCT/KR2013/011883 filed on Dec. 19, 2013, the entire disclosure of which is also incorporated herein by reference in its entirety.

BACKGROUND

1. Field

An apparatus and a method consistent with exemplary embodiments broadly relate to an audio correction apparatus and an audio correction method thereof, and more particularly, to an audio correction apparatus which detects onset information and pitch information of audio data and corrects the audio data according to onset information and pitch information of reference audio data, and an audio correction method thereof.

2. Description of Related Art

Technique for correcting a song, which is sung by an ordinary person who sings badly based on a score, are known. In particular, a related-art method for correcting the pitch of a song which is sung by a person according to the pitch of a score to correct the song is known.

However, a song which is sung by a person or a sound which is generated when a string instrument is played includes a soft onset in which notes are connected with one another. That is, in the case of a song which is sung by a person or a sound which is generated when a string instrument is played, when only the pitch is corrected without searching the onset which is a start point of each note, there may be a problem that the note is lost in the middle of the song or performance or the pitch is corrected from a wrong note.

SUMMARY

An aspect of exemplary embodiments is to provide an audio correction apparatus, which detects an onset and pitch of audio data and corrects the audio data according to the onset and pitch of reference audio data, and an audio correction method.

According to an aspect of an exemplary embodiment, an audio correction method includes: receiving audio data; detecting onset information by analyzing harmonic components of the received audio data; detecting pitch information of the received audio data based on the detected onset information; aligning the received audio data with the reference audio data based on the detected onset information and the detected pitch information; and correcting the aligned audio data to match the reference audio data.

The detecting the onset information may include cepstral analyzing the received audio data; analyzing the harmonic components of the cepstral-analyzed audio data, and detect the onset information based on the analyzing of the harmonic components.

The detecting the onset information may include: cepstral analyzing the received audio data; selecting a harmonic component of a current frame using a pitch component of a previous frame; calculating cepstral coefficients with respect to a plurality of harmonic components using the selected harmonic component of the current frame and the harmonic component of the previous frame; generating a detection function by calculating a sum of the calculated cepstral coefficients of the plurality of harmonic components; extracting an onset candidate group by detecting a peak of the generated detection function; and detecting the onset information by removing a plurality of adjacent onsets from the extracted onset candidate group.

The calculating may include determining whether the previous frame has the harmonic component, in response to the determining yielding that the harmonic component of the previous frame exists, calculating a high cepstral coefficient, and, in response to the determining yielding that no harmonic component of the previous frame exists, calculating a low cepstral coefficient.

The detecting the pitch information may include detecting the pitch information between the detected onset components using a correntropy pitch detection method.

The aligning may include comparing the received audio data with the reference audio data and aligning the received audio data with the reference audio data using a dynamic time warping method.

The aligning may include calculating an onset correction ratio and a pitch correction ratio of the received audio data to correspond to the reference audio data.

The correcting may include correcting the aligned audio data based on the calculated onset correction ratio and the pitch correction ratio.

The correcting may include correcting the aligned audio data by preserving a formant of the audio data using a SOLA method.

According to yet another aspect of an exemplary embodiment, an audio correction apparatus includes: an inputter configured to receive audio data; an onset detector configured to detect onset information by analyzing harmonic components of the audio data; a pitch detector configured to detect pitch information of the audio data based on the detected onset information; an aligner configured to align the audio data with the reference audio data based on the onset information and the pitch information; and a corrector configured to correct the audio data, which aligned with the reference audio data by the aligner, to match the reference audio data.

The onset detector may detect the onset information by cepstral analyzing the audio data and by analyzing the harmonic components of the cepstral-analyzed audio data.

The onset detector may include: a cepstral analyzer to perform a cepstral analysis of the audio data; a selector to select a harmonic component of a current frame using a pitch component of a previous frame; a coefficient calculator to calculate cepstral coefficients of a plurality of harmonic components using the selected harmonic component of the current frame and the harmonic component of the previous frame; a function generator to generate a detection function by calculating a sum of the cepstral coefficients of the plurality of harmonic components calculated by the coefficient calculator; an onset candidate group extractor to extract an onset candidate group by detecting a peak of the detection function generated by the function generator; and an onset information detector to detect the onset information by removing a plurality of adjacent onsets from the onset candidate group extracted by the onset candidate group extractor.

The audio correction apparatus may further include a harmonic component determiner to determine whether the previous frame has the harmonic component. In response to the harmonic component determiner determining that the harmonic component of the previous frame exists, the coefficient calculator may calculate a high cepstral coefficient, and, in response to the harmonic component determiner determining that no harmonic component of the previous frame exists, the coefficient calculator may calculate a low cepstral coefficient.

The pitch detector may detect the pitch information between the detected onset components using a correntropy pitch detection method.

The aligner may compare the audio data with the reference audio data and align the audio data with the reference audio data using a dynamic time warping method.

The aligner may calculate an onset correction ratio and a pitch correction ratio of the audio data with respect to the reference audio data.

The corrector may correct the audio data according to the calculated onset correction ratio and the calculated pitch correction ratio.

The corrector may correct the audio data by preserving a formant of the audio data using a SOLA method.

According to one or more exemplary embodiments, an onset detection method of an audio correction apparatus may include: performing cepstral analysis with respect to the audio data; selecting a harmonic component of a current frame using a pitch component of a previous frame; calculating cepstral coefficients with respect to a plurality of harmonic components using the harmonic component of the current frame and the harmonic component of the previous frame; generating a detection function by calculating a sum of the cepstral coefficients of the plurality of harmonic components; extracting an onset candidate group by detecting a peak of the detection function; and detecting the onset information by removing a plurality of adjacent onsets from the onset candidate group.

According to the above-described various exemplary embodiments, an onset can be detected from audio data in which the onsets are not clearly distinguished, such as a song which is sung by a person or a sound of a string instrument, and thus the audio data can be corrected more precisely.

BRIEF DESCRIPTION OF THE DRAWINGS

These and/or other aspects will become apparent and more readily appreciated from the following description of the exemplary embodiments, taken in conjunction with the accompanying drawings in which:

FIGS. 6A to 6D are views illustrating a dynamic time warping method according to an exemplary embodiment;

DETAILED DESCRIPTIONS OF EXEMPLARY EMBODIMENTS

Figure 1:
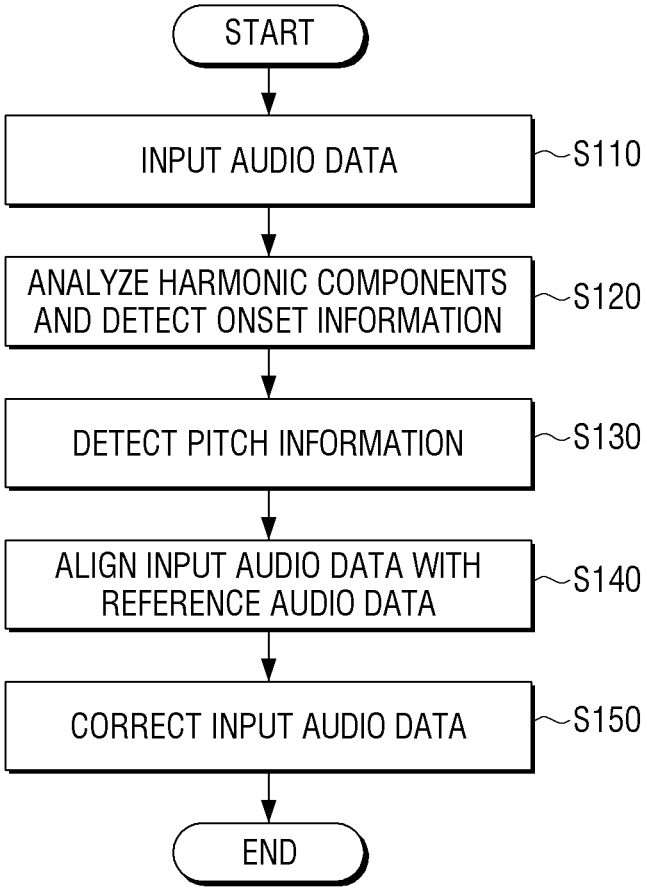
FIG. 1 is a flowchart illustrating an audio correction method according to an exemplary embodiment.

Hereinafter, exemplary embodiments will be explained in detail with reference to the accompanying drawings. FIG. 1 is a flowchart to illustrate an audio correction method of an audio correction apparatus according to an exemplary embodiment.

First, the audio correction apparatus receives an input of audio data (in operation S110). According to an exemplary embodiment, the audio data may be data which includes a song which is sung by a person or a sound which is made by a musical instrument.

The audio correction apparatus may detect onset information by analyzing harmonic components (in operation S120). The onset refers to a point where a musical note generally starts. However, the onset on a human voice may not be clear like glissandos, portamenti, and slur. Therefore, according to an exemplary embodiment, an onset included in a song which is sung by a person may refer to a point where a vowel starts.

In particular, the audio correction apparatus may detect the onset information using a Harmonic Cepstrum Regularity (HCR) method. The HCR method detects onset information by performing cepstral analysis with respect to audio data and analyzing harmonic components of the cepstral-analyzed audio data.

Figure 2:
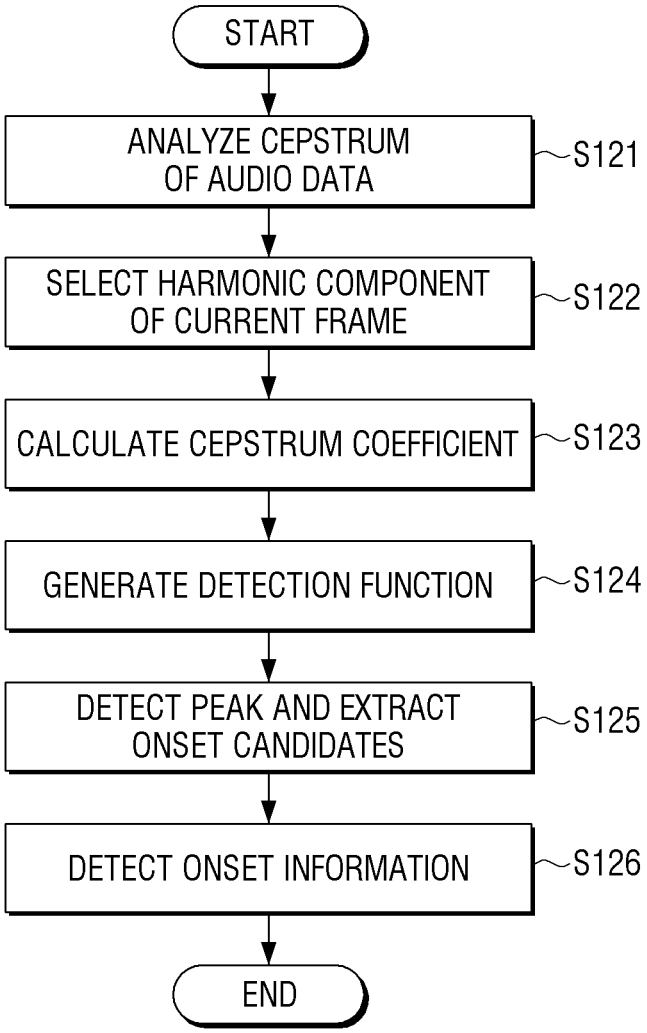
FIG. 2 is a flowchart illustrating a method of detecting onset information according to an exemplary embodiment.

The method for the audio correction apparatus to detect the onset information by analyzing the harmonic components according to an exemplary embodiment will be explained in detail with reference to FIG. 2.

First, the audio correction apparatus performs cepstral analysis with respect to the input audio data (in operation S121). Specifically, the audio correction apparatus may perform a pre-process such as pre-emphasis with respect to the input audio data. In addition, the audio correction apparatus performs fast Fourier transform (FFT) with respect to the input audio data. In addition, the audio correction apparatus may calculate the logarithm of the transformed audio data, and may perform the cepstral analysis by performing discrete cosine transform (DCT) with respect to the audio data.

In addition, the audio correction apparatus selects a harmonic component of a current frame (in operation S122). Specifically, the audio correction apparatus may detect pitch information of a previous frame and select a harmonic quefrency which is a harmonic component of a current frame using the pitch information of the previous frame.

In addition, the audio correction apparatus calculates a cepstral coefficient with respect to a plurality of harmonic components using the harmonic component of the current frame and the harmonic component of the previous frame (in operation S123). According to an exemplary embodiment, when there is a harmonic component of a previous frame, the audio correction apparatus calculates a high cepstral coefficient, and, when there is no harmonic component of a previous frame, the audio correction apparatus may calculate a low cepstral coefficient.

Figure 3A:
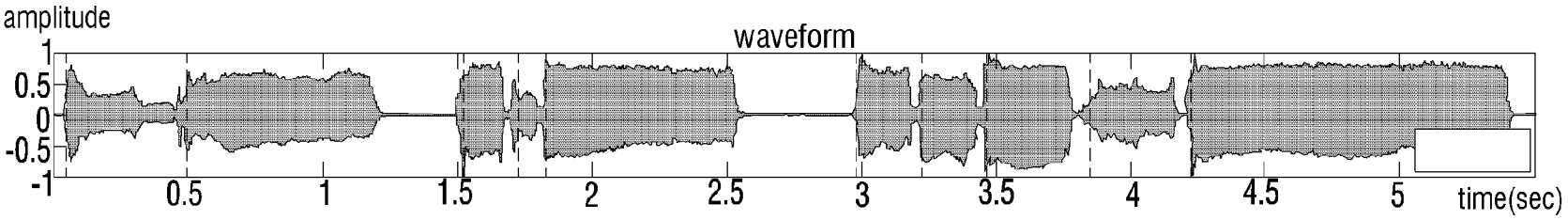
FIGS. 3A to 3D are graphs illustrating audio data which is generated while onset information is detected according to an exemplary embodiment.
Figure 3B:
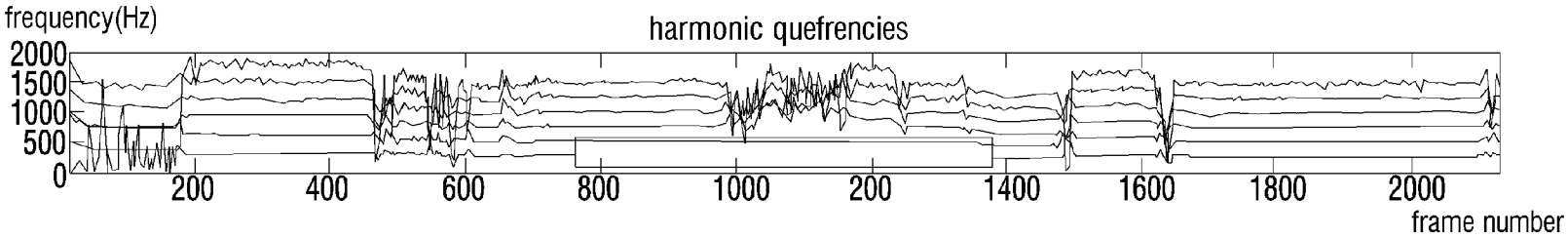
Figure 3C:
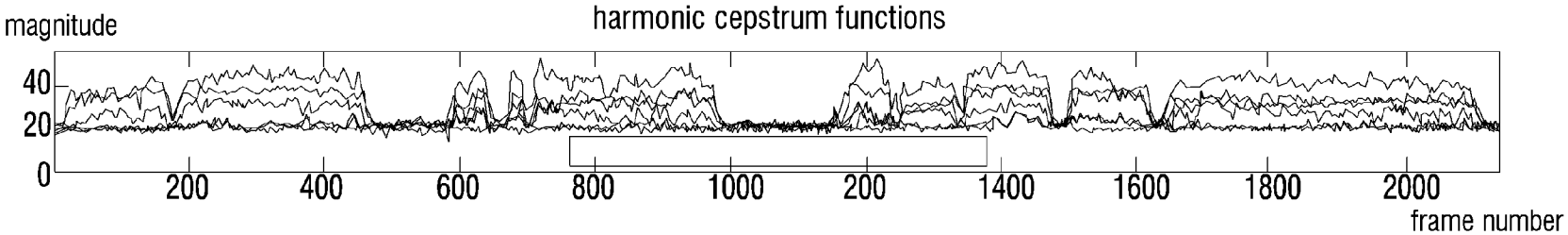
Figure 3D:
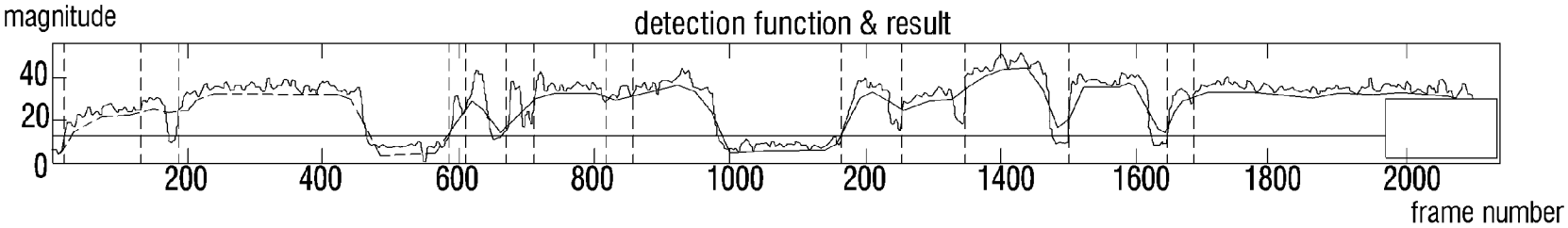

In addition, the audio correction apparatus generates a detection function by calculating a sum of the cepstral coefficients for the plurality of harmonic components (in operation S124). Specifically, the audio correction apparatus receives an input of audio data including a voice signal, as shown in FIG. 3A. In addition, the audio correction apparatus may detect a plurality of harmonic quefrencies through the cepstral analysis, as shown in FIG. 3B. In addition, the audio correction apparatus may calculate the cepstral coefficients of the plurality of harmonic components in operation S123, as shown in FIG. 3C, based on the harmonic quefrencies, as shown in FIG. 3B. In addition, the detection function may be generated, as shown in FIG. 3D, by calculating the sum of the cepstral coefficients of the plurality of harmonic components, as shown in FIG. 3C.

In addition, the audio correction apparatus extracts an onset candidate group by detecting the peak of the generated detection function (in operation S125). Specifically, when another harmonic component appears in the middle of existence of harmonic components, that is, at a point where an onset occurs, the cepstral coefficient abruptly changes. Therefore, the audio correction apparatus may extract a peak point where the detection function, which is the sum of the cepstral coefficients of the plurality of harmonic components, is abruptly changed. According to an exemplary embodiment, the extracted peak point may be set as the onset candidate group.

In addition, the audio correction apparatus detects onset information between the onset candidate groups (in operation S126). Specifically, from among the onset candidate groups extracted in operation S125, a plurality of onset candidate groups may be extracted from adjacent sections. The plurality of onset candidate groups extracted from the adjacent sections may be onsets which occur when the human voice trembles or other noises come in. Therefore, the audio correction apparatus may remove the other onset candidate groups except for only one onset candidate group from among the plurality of onset candidate groups of the adjacent sections, and detects only the one onset candidate group as onset information.

By detecting the onset through the cepstral analysis, as described above, according to an exemplary embodiment, an exact onset can be detected from audio data in which onsets are not clearly distinguished like in a song which is sung by a person or a sound which is made by a string instrument.

Table 1 presented below shows a result of detecting an onset using the HCR method, according to an exemplary embodiment:

TABLE 1

| Source | Precision | Recall | F-measure |
|---|---|---|---|
| Male 1 | 0.57 | 0.87 | 0.68 |
| Male 2 | 0.69 | 0.92 | 0.79 |
| Male 3 | 0.62 | 1.00 | 0.76 |
| Male 4 | 0.60 | 0.90 | 0.72 |
| Male 5 | 0.67 | 0.91 | 0.77 |
| Female 1 | 0.46 | 0.87 | 0.60 |
| Female 2 | 0.63 | 0.79 | 0.70 |

As described above, it can be seen that F-measures of various sources are calculated as 0.60-0.79. That is, considering that F-measure detected by various related-art algorithms is 0.19-0.56, an onset can be detected more exactly using the HCR method according to an exemplary embodiment.

Figure 4:
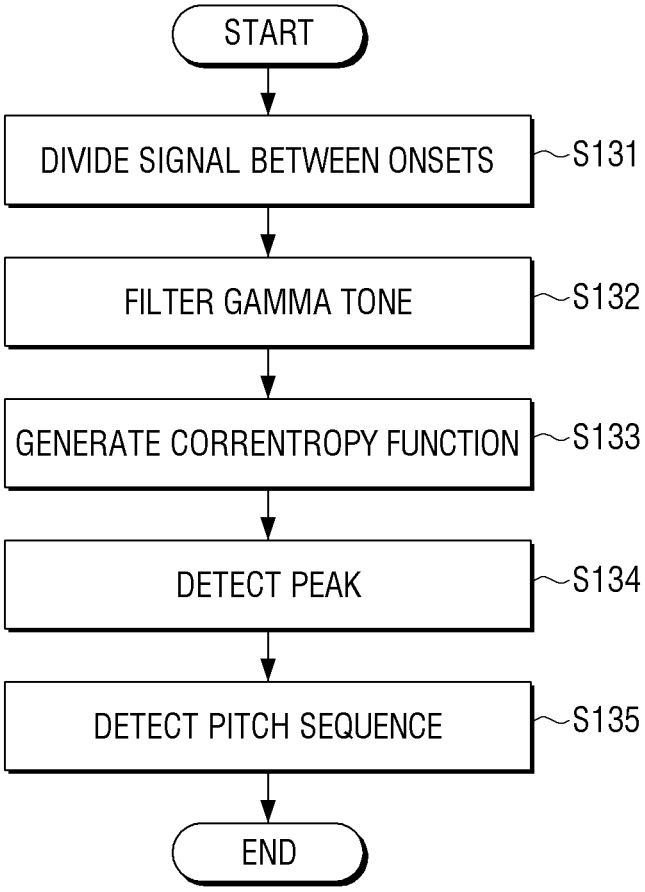
FIG. 4 is a flowchart illustrating a method of detecting pitch information according to an exemplary embodiment.

Referring back to FIG. 1, the audio correction apparatus detects pitch information based on the detected onset information (in operation S130). In particular, the audio correction apparatus may detect pitch information between the onset components detected using a correntropy pitch detection method. An exemplary embodiment in which the audio correction apparatus detects pitch information between the onset components using the correntropy pitch detection method will be explained with reference to FIG. 4.

In an exemplary embodiment, the audio correction apparatus divides a signal between the onsets (in operation S131). Specifically, the audio correction apparatus may divide a signal between the plurality of onsets based on the onset detected in operation S120.

In addition, the audio correction apparatus may perform gammatone filtering with respect to the input signal (in operation S132). Specifically, the audio correction apparatus applies 64 gammatone filters to the input signal. In an exemplary embodiment, the frequency of the plurality of gammatone filters is divided according to a bandwidth. In addition, the intermediate frequency of the filter is divided by the same interval, and the bandwidth is set between 80 Hz and 400 Hz.

In addition, the audio correction apparatus generates a correntropy function with respect to the input signal (in operation S133). It is common that the correntropy can obtain higher-dimensional statistics than in the related-art auto-correlation. Therefore, according to an exemplary embodiment, when a human voice is corrected, a frequency resolution is higher than in the related-art auto-correlation. The audio correction apparatus may obtain a correntropy function, as shown in Equation 1 presented below:

$$V(t,s)=E[k(x(t),x(s))] \quad \text{Equation 1}$$

x(t) and x(s) indicate an input signal when time is t and s respectively.

In this case, k(*,*) may be a kernel function which has a positive value and a symmetric characteristic. According to an exemplary embodiment, the kernel function may use Gaussian kernel. The correntropy function which is substituted with the equation of the Gaussian kernel and the Gaussian kernel may be expressed by Equation 2 and 3 presented below:

$$k(x(t), x(s)) = \frac{1}{\sqrt{2\pi\sigma}}\exp\left(-\frac{x(t)-x(s)^2}{2\sigma^2}\right) \quad \text{Equation 2}$$

$$V(t, s) = \frac{1}{2\sqrt{\pi\sigma}}\hat{Q}_{k=0}\frac{(-1)^k}{(2\sigma^2)^k k!}E[(x(t)-x(s))^{2k}] \quad \text{Equation 3}$$

Figure 5A:
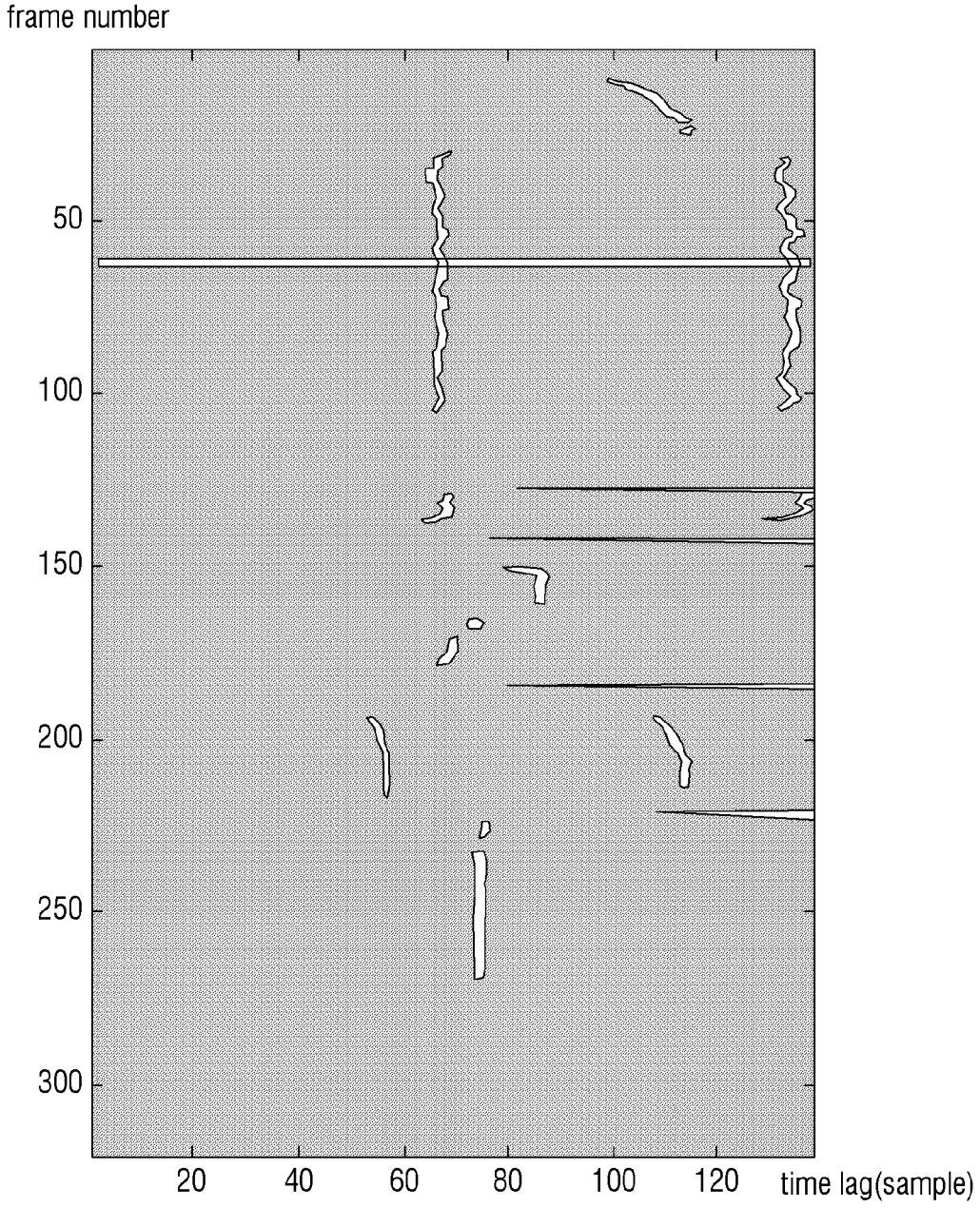
FIGS. 5A and 5B are graphs illustrating a method of detecting correntropy pitch according to an exemplary embodiment.
Figure 5B:
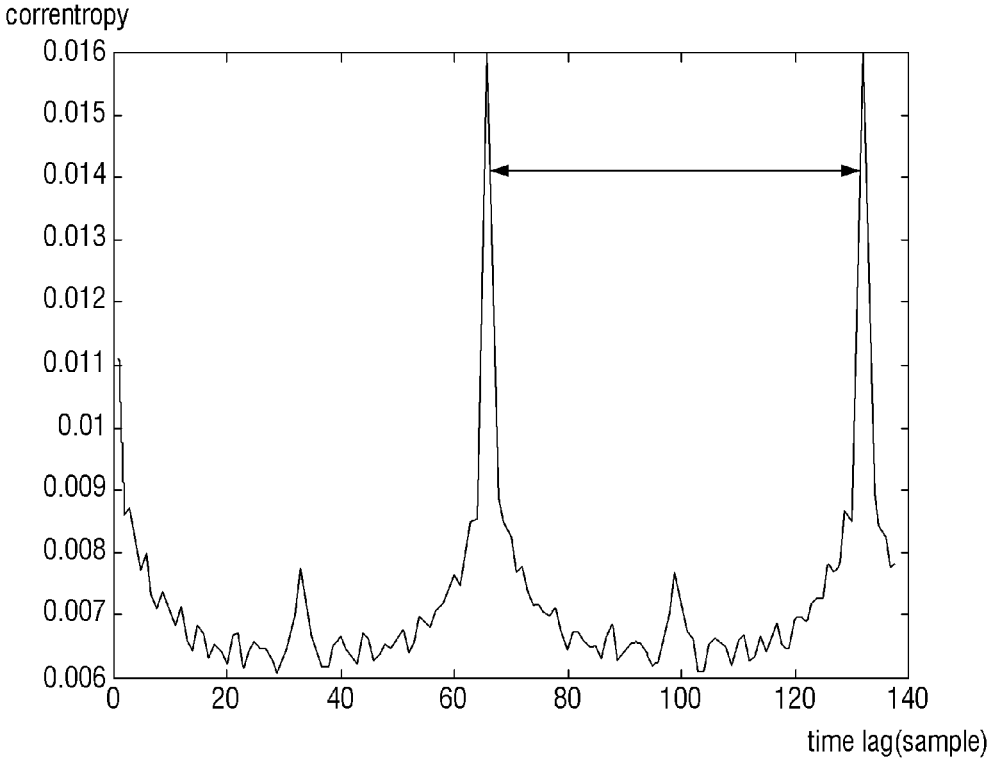

In addition, the audio correction apparatus detects the peak of the correntropy function (in operation S134). Specifically, when the correntropy is calculated, the audio correction apparatus may output a higher frequency resolution with respect to the input audio data than in the auto-correction, and detect a sharper peak than the frequency of the corresponding signal. According to an exemplary embodiment, the audio correction apparatus may measure the frequency which is greater than or equal to a predetermined threshold value from among the calculated peaks as a pitch of the input voice signal. More specifically, FIG. 5A is a view illustrating a normalized correntropy function according to an exemplary embodiment. The result of detecting correntropy of 70 frames is illustrated in FIG. 5B, according to an exemplary embodiment. In this case, a frequency value between the two peaks detected in FIG. 5B may refer to a tone, as shown with an arrow in FIG. 5B.

In addition, the audio correction apparatus may detect a pitch sequence based on the detected pitch (in operation S135). Specifically, the audio correction apparatus may detect pitch information with respect to the plurality of onsets and may detect a pitch sequence for every onset.

In the above-described exemplary embodiment, the pitch is detected using the correntropy pitch detection method. However, this is merely an example and not by way of a limitation, and the pitch of the audio data may be detected using other methods (for example, the auto-correlation method).

Referring back to FIG. 1, the audio correction apparatus aligns the audio data with reference audio data (in operation S140). In this case, the reference audio data may be audio data for correcting the input audio data.

In particular, the audio correction apparatus may align the audio data with the reference audio data using a dynamic time warping (DTW) method. Specifically, the dynamic time warping method is an algorithm for finding an optimum warping path by comparing similarity between the two sequences.

Figure 6A:
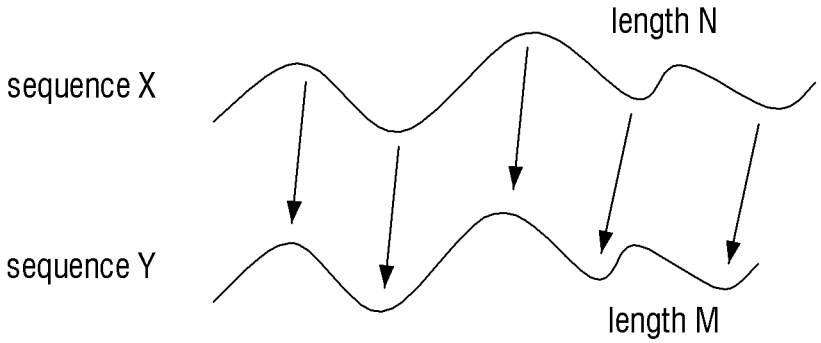

Specifically, the audio correction apparatus may detect sequence X with respect to the audio data input using operations S120 and S130, as shown in FIG. 6A, and may obtain sequence Y with respect to the reference audio data, as also shown in FIG. 6A. In addition, the audio correction apparatus may calculate a cost matrix by comparing similarity between sequence X and sequence Y, as shown in FIG. 6B.

Figure 6C:
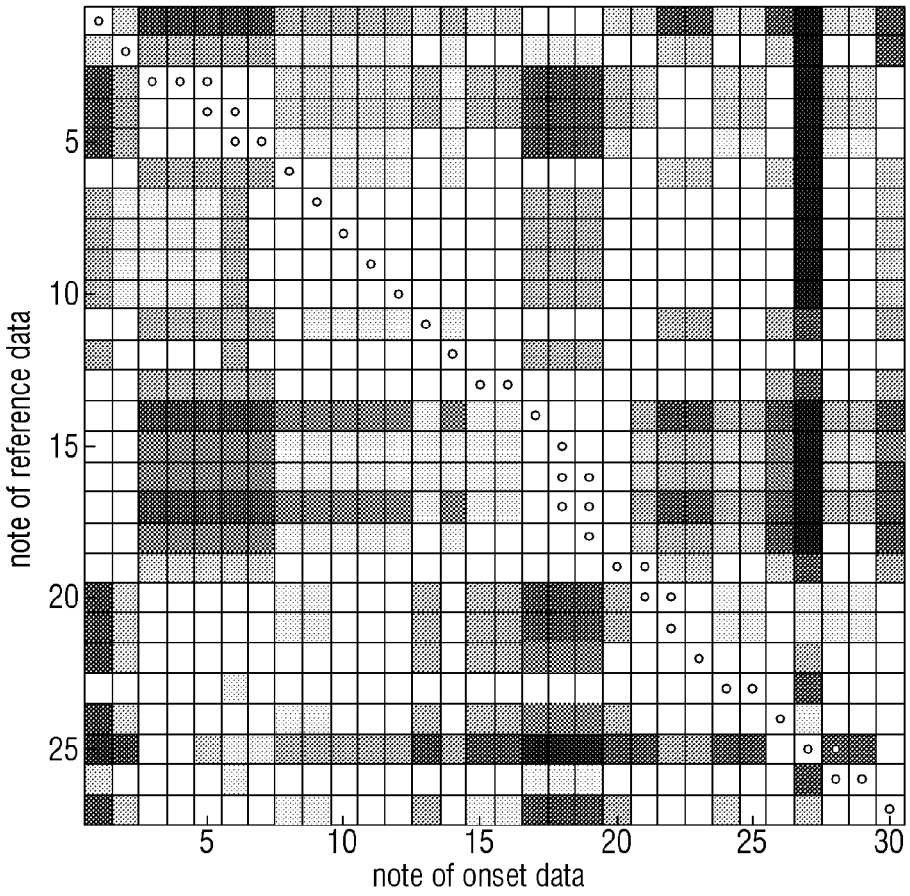
Figure 6D:
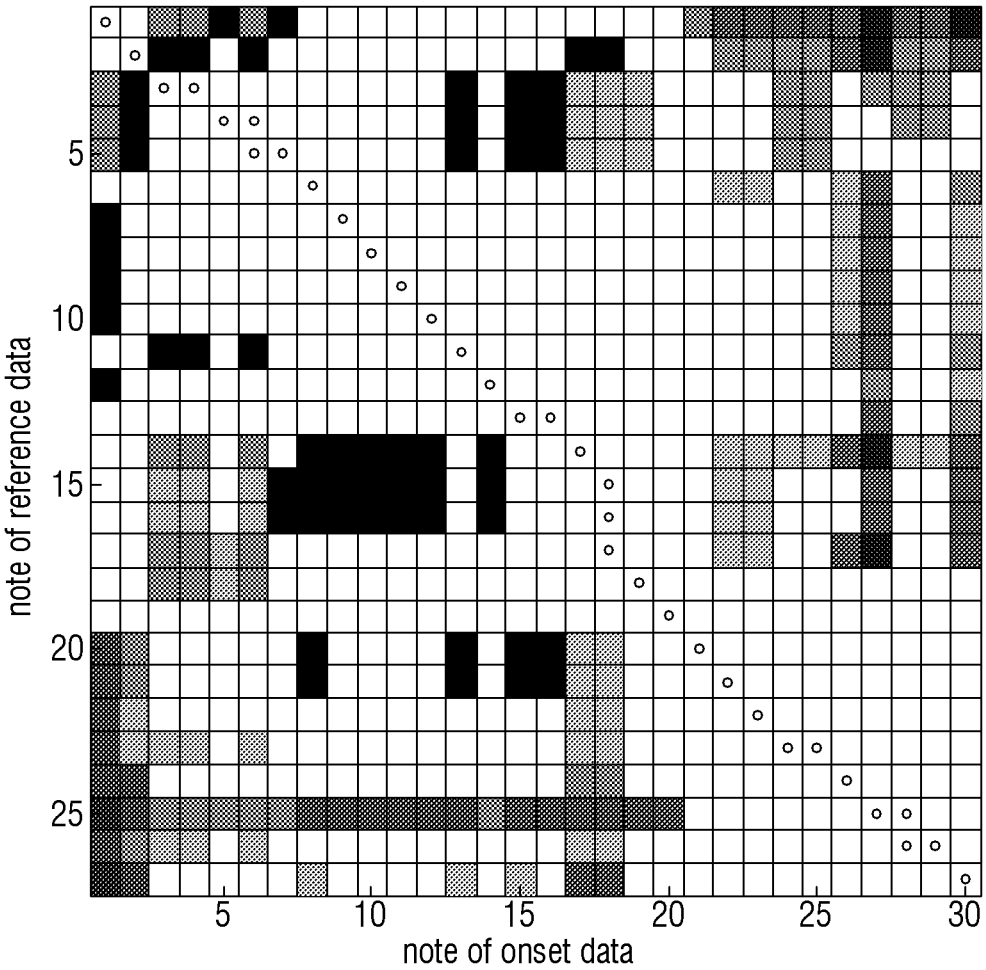

In particular, according to an exemplary embodiment, the audio correction apparatus may detect an optimum path for pitch information, as shown with a dotted line in FIG. 6C, and detect an optimum path for onset information, as shown with a dotted line in FIG. 6D. Therefore, a more exact alignment can be achieved than in the related-art method of detecting only an optimum path for pitch information.

According to an exemplary embodiment, the audio correction apparatus may calculate an onset correction ratio and a pitch correction ratio of the audio data with respect to the reference audio data while calculating the optimum path. The onset correction ratio may be a ratio for correcting the length of time of the input audio data (time stretching ratio), and the pitch correction ratio may be a ratio for correcting the frequency of the input audio data (pitch shifting ratio).

Referring back to FIG. 1, the audio correction apparatus may correct the input audio data (in operation S150). According to an exemplary embodiment, the audio correction apparatus may correct the input audio data to match the reference audio data using the onset correction ratio and the pitch correction ratio calculated in operation S140.

In particular, the audio correction apparatus may correct the onset information of the audio data using a phase vocoder. Specifically, the phase vocoder may correct the onset information of the audio data through analysis, modification, and synthesis. In an exemplary embodiment, the onset information correction in the phase vocoder may stretch or reduce the time of the input audio data by differently setting an analysis hopsize and a synthesis hopsize.

Figure 7:
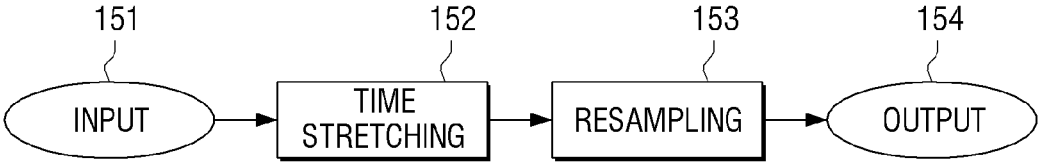
FIG. 7 is a view illustrating a time stretching correction method of audio data according to an exemplary embodiment.

In addition, the audio correction apparatus may correct the pitch information of the audio data using the phase vocoder. According to an exemplary embodiment, the audio correction apparatus may correct the pitch information of the audio data using a change in the pitch which occurs when a time scale is changed through re-sampling. Specifically, the audio correction apparatus performs time stretching 152 with respect to the input audio data 151, as shown in FIG. 7A. According to an exemplary embodiment, the time stretching ratio may be equal to the analysis hopsize divided by the synthesis hopsize. In addition, the audio correction apparatus outputs the audio data 154 through re-sampling 153. According to an exemplary embodiment, the re-sampling ratio may be equal to the synthesis hopsize divided by the analysis hopsize.

In addition, when the audio correction apparatus corrects the pitch through re-sampling, the input audio data may be multiplied with an alignment coefficient_P, which is predetermined to maintain a formant even after re-sampling, in advance, in order to prevent the formant from being changed. The alignment coefficient P may be calculated by Equation 4 presented below:

$$P(k) = \frac{A(k \cdot f)}{A(k)} \qquad \text{Equation 4}$$

In this case, A(k) is a formant envelope.

In addition, in the case of a general phase vocoder, distortion such as ringing may be caused. This is a problem which is caused by phase discontinuity of a time axis which occurs by correcting phase discontinuity of a frequency axis. To solve this problem, according to an exemplary embodiment, the audio correction apparatus may correct the audio data by preserving the formant of the audio data using a synchronized overlap add (SOLA) algorithm. Specifically, the audio correction apparatus may perform phase vocoding with respect to some initial frames, and then, may remove the discontinuity which occurs on the time axis by synchronizing the input audio data with data which undergoes the phase vocoding.

According to the above-described audio correction method of an exemplary embodiment, the onset can be detected from the audio data in which the onsets are not clearly distinguished, such as a song which is sung by a person or a sound of a string instrument, and thus, the audio data can be corrected more exactly or precisely.

Figure 8:
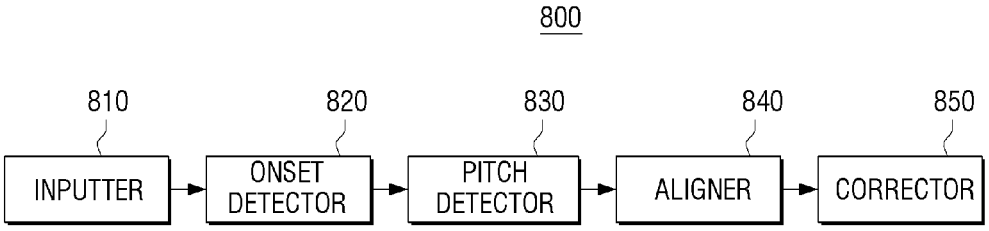
FIG. 8 is a block diagram schematically illustrating a configuration of an audio correction apparatus according to an exemplary embodiment.

Hereinafter, an audio correction apparatus 800 according to an exemplary embodiment will be explained in detail with reference to FIG. 8. As shown in FIG. 8, the audio correction apparatus 800 includes an inputter 810, an onset detector 820, a pitch detector 830, an aligner 840, and a corrector 850. According to an exemplary embodiment, the audio correction apparatus 800 may be implemented by using various electronic devices such as a smartphone, a smart TV, a tablet PC, or the like.

The inputter 810 receives an input of audio data. According to an exemplary embodiment, the audio data may be a song which is sung by a person or a sound of a string instrument. An inputter may be a microphone with a sensor configured to detect audio signals.

The onset detector 820 may detect an onset by analyzing harmonic components of the input audio data. Specifically, the onset detector 820 may detect onset information by performing cepstral analysis with respect to the audio data and then analyzing the harmonic components of the cepstral-analyzed audio data. In particular, the onset detector 820 performs cepstral analysis with respect to the audio data as shown in FIG. 2, by way of an example. In addition, the onset detector 820 selects a harmonic component of a current frame using a pitch component of a previous frame, and calculates cepstral coefficients with respect to the plurality of harmonic components using the harmonic component of the current frame and the harmonic component of the previous frame. In addition, the onset detector 820 generates a detection function by calculating a sum of the cepstral coefficients with respect to the plurality of harmonic components. The onset detector 820 extracts an onset candidate group by detecting a peak of the detection function, and detects onset information by removing a plurality of adjacent onsets from among the onset candidate groups.

The pitch detector 830 detects pitch information of the audio data based on the detected onset information. According to an exemplary embodiment, the pitch detector 830 may detect pitch information between the onset components using a correntropy pitch detection method. However, this is merely an example and not by way of a limitation, and the pitch information may be detected using other methods.

The aligner 840 compares the input audio data and reference audio data and aligns the input audio data with reference audio data based on the detected onset information and pitch information. In this case, the aligner 840 may compare the input audio data and the reference audio data and align the input audio data with the reference audio data using a dynamic time warping method. According to an exemplary embodiment, the aligner 840 may calculate an onset correction ratio and a pitch correction ratio of the input audio data with respect to the reference audio data.

The corrector 850 may correct the input audio data aligned with the reference audio data to match the reference audio data. In particular, the corrector 850 may correct the input audio data according to the calculated onset correction ratio and pitch correction ratio. In addition, the corrector 850 may correct the input audio data using an SOLA algorithm to prevent a change of a formant which may be caused when the onset and pitch are corrected. In an exemplary embodiment, the onset detector 820, the pitch detector 830, the aligner 840, and the corrector 850 may be implemented by a hardware processor or a combination of processors. The corrected input audio data may be output via speakers (not shown).

The above-described audio correction apparatus 800 can detect the onset from the audio data in which the onsets are not clearly distinguished, such as a song which is sung by a person or a sound of a string instrument, and thus can correct the audio data more exactly and/or precisely.

In particular, when the audio correction apparatus 800 is implemented by using a user terminal such as a smartphone, exemplary embodiments may be applicable to various scenarios. For example, the user may select a song that the user wants to sing. The audio correction apparatus 800 obtains reference MIDI data of the song selected by the user. When a record button is selected by the user, the audio correction apparatus 800 displays a score and guides the user to sing the song more exactly or precisely i.e., more closely to how it should be sung. When the recording of the user's song is completed, the audio correction apparatus 800 corrects the user's song, according to an exemplary embodiment described above with reference to FIGS. 1 to 8. When a re-listening command is input by the user, the audio correction apparatus 800 can replay the corrected song. In addition, the audio correction apparatus 800 may provide an effect such as chorus or reverb to the user. In this case, the audio correction apparatus 800 may provide the effect such as chorus or reverb to the song of the user which has been recorded and then corrected. When the correction is completed, the audio correction apparatus 800 may replay the song according to a user command or may share the song with other persons through a Social Network Service (SNS).

The audio correction method of the audio correction apparatus 800 according to the above-described various exemplary embodiments may be implemented as a program and provided to the audio correction apparatus 800. In particular, the program including the sensing method of the mobile device 100 may be stored in a non-transitory computer readable medium and provided for use by the device.

The non-transitory computer readable medium refers to a medium that stores data semi-permanently rather than storing data for a very short time, such as a register, a cache, and a memory, and is readable by an apparatus. Specifically, the above-described various applications or programs may be stored in a non-transitory computer readable medium such as a compact disc (CD), a digital versatile disk (DVD), a hard disk, a Blu-ray disk, a universal serial bus (USB), a memory card, and a read only memory (ROM), and may be provided for use by a device.

The foregoing exemplary embodiments are merely exemplary and are not to be construed as limiting the present inventive concept. The exemplary embodiments can be readily applied to other types of apparatuses. Also, the description of the exemplary embodiments is intended to be illustrative, and not to limit the scope of the claims, and many alternatives, modifications, and variations will be apparent to those skilled in the art.

What is claimed is:

1. An audio correction method comprising:

receiving audio data;

cepstral analyzing the received audio data;

analyzing harmonic components of the cepstral-analyzed audio data;

generating a detection function based on cepstral coefficients of the analyzed harmonic components:

detecting onset information in the received audio data based on the generated detection function;

detecting pitch information of the received audio data based on the detected onset information;

aligning the received audio data with reference audio data based on the detected onset information and the detected pitch information; and correcting the aligned audio data to match the reference audio data.

2. The audio correction method of claim 1, wherein the detecting the onset information comprises:

selecting a harmonic component of a current frame using a pitch component of a previous frame;

calculating said cepstral coefficients with respect to the harmonic components using the selected harmonic component of the current frame and the harmonic component of the previous frame;

generating the detection function by calculating a sum of the calculated cepstral coefficients of the plurality of harmonic components;

extracting an onset candidate group by detecting a peak of the generated detection function; and detecting the onset information by removing a plurality of adjacent onsets from the extracted onset candidate group.

3. The audio correction method of claim 2, wherein the calculating the cepstral coefficients comprises:

determining whether the previous frame has the harmonic component;

in response to the determining yielding that the harmonic component of the previous frame exists, calculating a high cepstral coefficient; and in response to the determining yielding that no harmonic component of the previous frame exists, calculating a low cepstral coefficient.

4. The audio correction method of claim 1, wherein the detecting the pitch information comprises detecting the pitch information between the detected onset components using a correntropy pitch detection method.

5. The audio correction method of claim 1, wherein the aligning the received audio data with the reference audio data comprises:

comparing the received audio data with the reference audio data; and aligning the received audio data with the reference audio data using a dynamic time warping method.

6. The audio correction method of claim 5, wherein the aligning the received audio data with the reference audio data comprises:

calculating an onset correction ratio and a pitch correction ratio of the received audio data to correspond to the reference audio data.

7. The audio correction method of claim 6, wherein the correcting the aligned audio data to match the reference audio data comprises correcting the aligned audio data based on the calculated onset correction ratio and the pitch correction ratio.

8. The audio correction method of claim 1, wherein the correcting the aligned audio data comprises correcting the aligned audio data by preserving a formant of the received audio data using a synchronized overlap add (SOLA) method.

9. The audio correction method of claim 1, wherein the detecting the onset information further comprises calculating the cepstral coefficients with respect to the analyzed harmonic components using harmonic component of the previous frame and generating the detection function based on the calculated cepstral coefficients.

10. The audio correction method of claim 9, wherein the detecting the onset information in the received audio data further comprises:

extracting an onset candidate group based on the calculated cepstral coefficients; and detecting the onset information by removing a plurality of adjacent onsets from the extracted onset candidate group, wherein the onset comprises one of a point in the received audio data where a musical note starts and a point where a vowel starts in a song, and wherein the onset information comprises at least one onset in a current audio frame.

11. An audio correction apparatus comprising:

an inputter configured to receive audio data;

an onset detector configured to detect onset information in the received audio data by analyzing harmonic components of the audio data;

a pitch detector configured to detect pitch information of the audio data based on the detected onset information;

an aligner configured to align the audio data with reference audio data based on the onset information and the pitch information; and a corrector configured to correct the audio data, aligned with the reference audio data by the aligner, to match the reference audio data, wherein the onset detector is configured to detect the onset information by cepstral analyzing the audio data, by analyzing the harmonic components of the cepstral-analyzed audio data, by generating a detection onset function based on cepstral coefficients of the analyzed harmonic components.

12. The audio correction apparatus of claim 11, wherein the onset detector comprises:

a selector configured to select a harmonic component of a current frame using a pitch component of a previous frame;

a coefficient calculator configured to calculate the cepstral coefficients of the harmonic components using the selected harmonic component of the current frame and the harmonic component of the previous frame;

a function generator configured to generate the detection function by calculating a sum of the cepstral coefficients of the plurality of harmonic components calculated by the coefficient calculator;

an onset candidate group extractor configured to extract an onset candidate group by detecting a peak of the detection function generated by the function generator; and an onset information detector configured to detect the onset information by removing a plurality of adjacent onsets from the onset candidate group extracted by the onset candidate group extractor.

13. The audio correction apparatus of claim 12, further comprising:

a harmonic component determiner configured to determine whether the previous frame has the harmonic component, wherein, in response to the harmonic component determiner determining that the harmonic component of the previous frame exists, the coefficient calculator is configured to calculate a high cepstral coefficient, and wherein, in response to the harmonic component determiner determining that no harmonic component of the previous frame exists, the coefficient calculator is configured to calculate a low cepstral coefficient.

14. The audio correction apparatus of claim 11, wherein the pitch detector is configured to detect the pitch information between the detected onset components using a correntropy pitch detection method.

15. The audio correction apparatus of claim 11, wherein the aligner is configured to:

compare the audio data with the reference audio data, and align the compared audio data with the reference audio data using a dynamic time warping method.

16. A non-transitory computer readable medium storing executable instructions, which in response to being executed by a processor, cause the processor to perform the following operations comprising:

receiving audio data;

detecting onset information by analyzing harmonic components of the received audio data;

detecting pitch information of the received audio data based on the detected onset information;

comparing the received audio data with reference audio data;

aligning the received audio data with the reference audio data based on the detected onset information and the detected pitch information; and correcting the aligned audio data to match the reference audio data, wherein the processor detects the onset information based on selecting one of the analyzed harmonic components of the received audio data for a current frame based on a pitch component of a previous frame.

17. An audio correction method comprising:

receiving audio data;

detecting onset information in the received audio data by analyzing harmonic components of the received audio data;

detecting pitch information of the received audio data based on the detected onset information;

aligning the received audio data with reference audio data based on the detected onset information and the detected pitch information; and correcting the aligned audio data to match the reference audio data, wherein the detecting the onset information for a current frame is based on selecting one of the analyzed harmonic components for the current frame based on a pitch component of a previous frame.

* * * * *